US005655577A

United States Patent [19]

Loen et al.

[11] Patent Number: 5,655,577

[45] Date of Patent: Aug. 12, 1997

[54] FUEL DISPENSER

[75] Inventors: Andrew Everett Loen, Port Alberni; Jesse Stuart Houle, New Westminster; David Alvin Besler, Burnaby; Scott Robert Anderson, North Vancouver, all of Canada

[73] Assignee: Shell Oil Company, Houston, Tex.

[21] Appl. No.: 461,282

[22] Filed: Jun. 5, 1995

[51] Int. Cl.[6] ..... B65B 1/04

[52] U.S. Cl. ..... 141/59; 141/95; 141/198; 141/392

[58] Field of Search ..... 141/59, 94, 95, 141/96, 198, 392, 206–226; 250/900, 904, 341.2; 222/52

[56] References Cited

U.S. PATENT DOCUMENTS

| | | | |
|---|---|---|---|
| 3,580,414 | 5/1971 | Ginsburgh et al. | 220/86 |
| 4,503,994 | 3/1985 | Pyle | 222/64 |
| 4,505,308 | 3/1985 | Walker et al. | 141/59 |
| 5,121,777 | 6/1992 | Leininger et al. | 141/207 |
| 5,131,441 | 7/1992 | Simpson et al. | 141/209 |
| 5,431,199 | 7/1995 | Benjay et al. | 141/59 |

*Primary Examiner*—Henry J. Recla
*Assistant Examiner*—Steven O. Douglas
*Attorney, Agent, or Firm*—Del S. Christensen

[57] ABSTRACT

A fuel dispensing nozzle is provided, the fuel dispenser comprising: a) a vapor recovery conduit effective to provide communication between a vapor space of a fuel tank to be refuelled and a system to remove vapors displaced by fuel added to the tank; b) a fuel supply conduit; c) a sealing device effective to mate in a sealing relationship with a fuel tank inlet; d) an optical liquid sensor within the vapor recovery conduit that is effective to generate a control signal when liquid is detected within the vapor recovery conduit; and e) a device to disenable fuel flow when a control signal is generated by the optical liquid sensor. Also, the fuel dispenser comprises a sealing device that comprises a device to determine if a sealing relationship exists between the fuel dispenser and the fuel tank inlet.

9 Claims, 1 Drawing Sheet

FUEL DISPENSER

FIELD OF INVENTION

This invention relates to a method and apparatus for dispensing a fluid such a gasoline.

BACKGROUND TO THE INVENTION

Gasoline refilling stations are typically equipped with vapor recovery systems to reduce emissions of hydrocarbon vapors during refilling of motor vehicles. Such systems vary in their details, but usually comprise a vapor line either concentric around a fuel line, or a second tube extending to near a fuel outlet nozzle. Vapors are drawn through the vapor line at a rate that can exceed the volumetric rate at which gasoline is pumped through the fuel line. A portion of the vapors removed from the vehicle's fuel tank are routed back to the fuel storage tank at the filling station to minimize the amount of vapor eventually vented to the atmosphere, and any vapors vented to the atmosphere are typically passed through an activated carbon filter.

It is also common for a fuel nozzle to be equipped with a seal that mates with a vehicle's fuel inlet to ensure that gasoline vapors do not escape from the fuel tank, and to provide a closer balance between the amount of vapor removed from the vehicle's fuel tank and the amount of vapor needed to maintain pressure in the fuel storage tank at the filling station.

Common problems with vapor recovery systems include overfilling of fuel tanks, resulting in liquids entering the vapor recovery system, and the difficulty of knowing when a seal between the fuel dispenser and the fuel tank inlet is achieved.

Numerous apparatuses have been proposed for preventing over-filling of fuel tanks during refuelling. The most common used method is an automatic cut-off within a dispenser nozzle. Typically this automatic cut-off uses a vapor path from the nozzle outlet back to a venturi around the fuel flow path within the nozzle. A sufficiently high pressure must be maintained at a point within this path to indicate that vapor is being drawn into the vapor path rather than liquids. When liquids enter the vapor path, the pressure drop in the path increases, and the pressure at the sensor point will decrease. When this pressure decreases below a threshold pressure, the fuel flow is cut-off, usually by a mechanical trip. When a vapor recovery nozzle that seals the fuel inlet is incorporated with a vacuum assist vapor recovery fuel dispenser, this automatic fuel cut-off will not function properly because pressure at the pressure sensor is subject to variations due to variations in the vapor recovery system. Such variations result in the shut-off not having sufficient consistency.

An electo-mechanical fuel cut-off switch is disclosed in U.S. Pat. No. 5,131,441. This switch incudes an electromagnetic clutch that enables the trigger of a nozzle to close. When fluids are detected by a fluid actuated switch located in the nozzle spout, electrical energy to the electromagnetic clutch is interrupted, and the fuel valve is closed. This mechanism is said to be quick-acting, and therefore minimizes splash-back losses to the environment. An optical liquid sensor is suggested as the fluid actuated switch. The fluid actuated switch is located within a baffled channel in the nozzle in the fuel dispenser of '441. The location of the switch within the nozzle relies on the fluid level raising within the baffled channel of the nozzle. Because vapor is trapped within the closed volume of the nozzle, liquid will not necessarily back-up in the nozzle, but could raise outside the nozzle and be drawn into the vapor recovery system.

Liquids could therefore be exiting the fuel tank into the vapor recovery system before the fuel flow is cut off by the mechanism of patent '441.

Another fuel dispenser having a vapor recovery system is suggested in U.S. Pat. No. 5,121,777. This dispenser includes a flexible boot surrounding the fuel nozzle that encloses a vapor recover conduit. The flexible boot includes an electro-mechanical switch that must be closed as one of three requirements for the fuel flow to be enabled. The electro-mechanical switch is closed when the boot is compressed against a vehicle's fuel inlet nozzle. The electro-mechanical switch requires that an electrical contact be made within the fuel dispenser right at the mouth of the fuel tank. It would be preferable to have a system that does not require an electro-mechanical switch because a such a switch can be unreliable, and because of the possibility that it could be a source of ignition.

It is therefore an object of the present invention to provide a method and apparatus for cutting off fuel flow in a fuel dispensing nozzle wherein a significant amount of fuel is not drawn into a vapor recovery system before the fuel flow is discontinued. In another aspect of the present invention, it is an object to provide a fuel dispenser wherein a determination that a sealing contact is made between the fuel dispenser and a fuel inlet of a vehicle without requiring a mechanical switch.

SUMMARY OF THE INVENTION

These and other objects of the present invention are achieved in one aspect of the present invention by a fuel dispensing nozzle comprising: a) a vapor recovery conduit effective to provide communication between a vapor space of a fuel tank to be refuelled and a system to remove vapors displaced by fuel added to the tank; b) a fuel supply conduit; c) a sealing means effective to mate in a sealing relationship with a fuel tank inlet and separate the vapor space and surrounding atmosphere other than through the system to remove vapors; d) an optical liquid sensor within the vapor recovery conduit that is effective to generate a control signal when liquid is detected within the vapor recovery conduit; and e) a means to disenable fuel flow when a control signal is generated by the optical liquid sensor.

In another aspect of the present invention, the fuel dispenser comprises a sealing means that comprises a means to determine if a sealing relationship exists between the fuel dispenser and the fuel tank inlet and the sealing means further comprises an elastomeric boot having a concentric elastomeric sealing surface and the means to determine if a sealing relationship exists between the fuel dispenser and the fuel tank inlet comprises at least one slit into the elastomeric boot extending from a point outside of the sealing surface to a point within the elastomeric boot inside of the sealing surface and the slit being in communication with atmosphere surrounding the boot, a conduit terminating at the point within the elastomeric boot and providing communication with a source of gas supply, and a means to determine if the pressure within the conduit terminating a the point within the elastomeric boot exceeds a threshold pressure indicative of a sealing relationship between the sealing surface of the boot and a fuel tank inlet. The elastomeric boot preferably includes a conical insert that is not elastomeric inside of the sealing surface. This conical insert, being hard rather than elastomeric, is effective to help center the sealing surfaces.

According to the first aspect of the present invention, an optical liquid sensor is utilized in a vapor recovery line to determine if the fuel tank has been filled. A signal from this optical sensor then shuts off fuel flow by, for example, closing a valve in the fuel supply conduit. According to the second aspect of the present invention, existence of a sealing contact between a sealing surface of the fuel dispenser and a fuel inlet nozzle is determined by providing a flexible flap on the face of the sealing surface, and supplying a gas, such as air, to the inside of the flap. The back pressure on the air supplied to the flap indicates whether or not the sealing surface is effectively pressed against the fuel inlet to form a seal. When a sufficient back pressure is measured, the fueling process is permitted to proceed.

DESCRIPTION OF A PREFERRED EMBODIMENT

Figure 1:
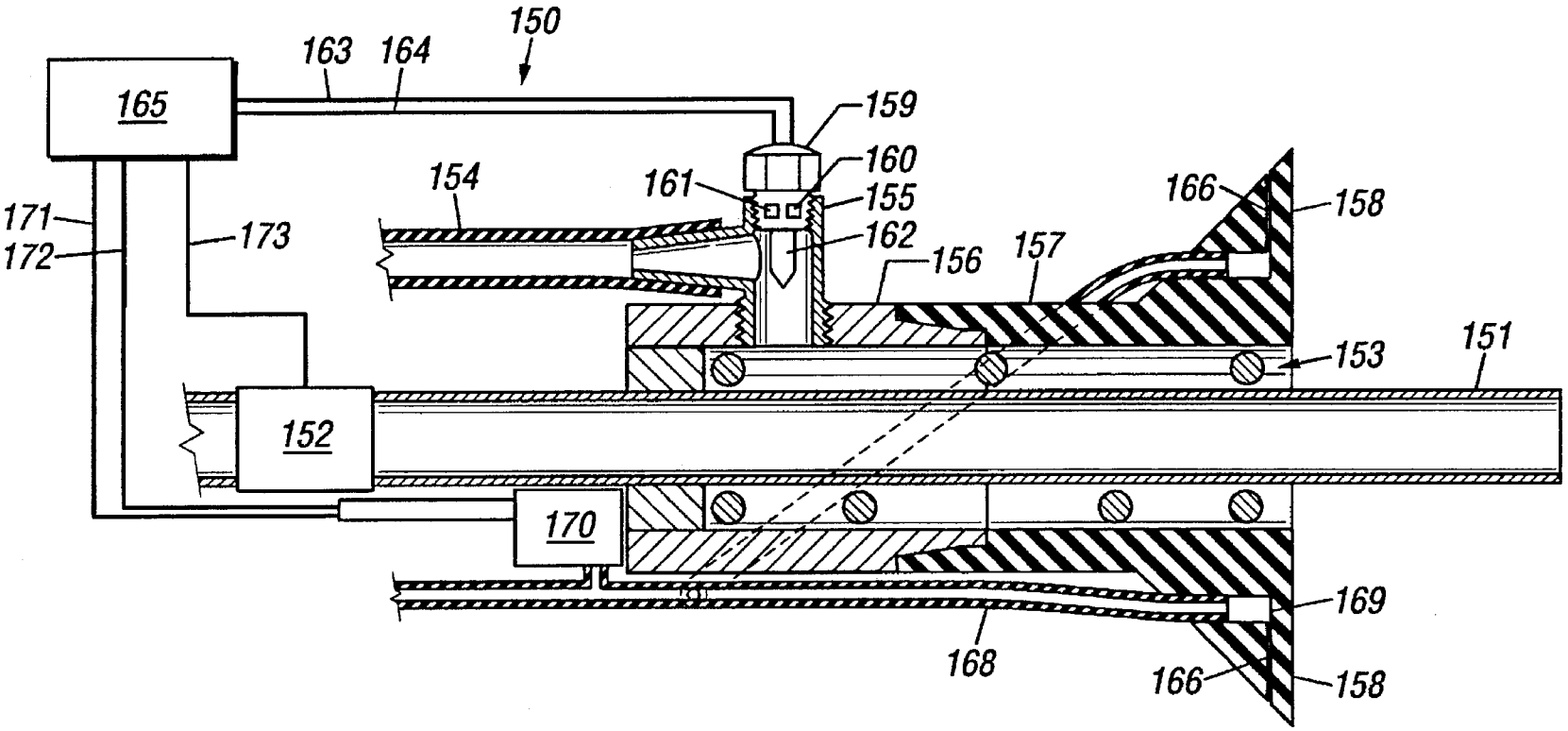
FIG. 1 is a schematic drawing of a system for the practice of the present invention.

Referring now to FIG. 1, a sketch of a fuel dispenser 150 according to the present invention is shown. A fuel conduit 151 supplies fuel into a tank to be refilled (not shown). A valve 152 is capable of shutting off fuel flow through the fuel conduit. A vapor recovery conduit 153 provides a path for removal of vapor from the fuel tank as liquid fuel is added. The vapor recovery conduit is shown as concentric around the fuel supply conduit. Other arrangements are acceptable, but a concentric arrangement is preferred. The concentric volume is in communication with a separate vacuum line 154 through a fitting 155. A rigid section 156 is shown surrounding a portion of the concentric vapor recovery conduit. The rigid section 156 also supports an elastomeric boot 157. The elastomeric boot has a sealing surface 158 that is capable of mating with an inlet of a fuel tank. The sealing surface is preferably concentric around both the vapor recovery conduit and the fuel supply conduit. The elastomeric boot can be molded from one of many known elastomeric materials such as vulcanized polybutadiene or silicone rubber. The sealing surface is shown as a flat surface having a face perpendicular to the central axis of the fuel flow conduit, but an angled face that is partially inserted into the fuel tank inlet would also be acceptable. A sealing surface that is not flat could also be acceptable. In particular, the sealing surface could be formed to match a contour of a fuel tank inlet nozzle.

An optical liquid sensor 159 is shown placed within the vapor recovery conduit. The optical liquid sensor is preferably placed close to the sealing surface and elastomeric boot in order to result in a minimal amount of liquid being in the vapor recovery conduit when liquid is first detected by the optical liquid detector. The optical liquid detector can be one of the commercially available optical liquid detectors available from, for example, Cesco Electrical Supply Ltd. of Burnaby, British Columbia, and manufactured by Electromatic of Hadsten, Denmark. These sensors comprise a source of light, 160 such as infrared light, a photo cell light detector 161, and a reflector element 162. The reflector element may be, for example, a U shaped element, or a cylinder having a conical reflector end. The reflector element is fabricated from a material such as polysulphone that has a high refractive index when compared to vapor, but not when compared to liquid. The generated light therefore passes out of the reflector element when the reflector element is surrounded by liquid, but reflected by total internal reflection back to the photo cell when the reflector element is surrounded by vapor. The optical liquid sensor will generally require a power supply 163 and will generate a signal that can be transmitted through a signal cable 164. Both the power supply and the signal cable may be connected to a control unit 165. The control unit may be, for example, a simple logic chip within the handle of the fuel dispenser, or may be within a computer that controls the refuelling operation.

The optical liquid sensor of the present invention can be, and is preferably, used as a back-up to a primary system for preventing overfilling of a fuel tank by the fuel dispenser of the present invention. For example, a fuel supply cut-off disclosed in U.S. patent application Ser. No. 08/461,487, filed Jun. 5, 1995 , (incorporated herein by reference) could be used as a primary fuel supply cut-off, with the optical liquid sensor of the present invention providing a back-up to the primary fuel supply cut-off. The present optical liquid sensor is preferred as a back-up because it is preferable to discontinue fuel flow prior to liquids entering the vapor recovery conduit.

A slit 166 is provided near the face of the sealing surface. The slit 166 provides communication between the atmosphere surrounding the elastomeric boot (outside of the sealing surface) and a point within the elastomeric boot inside of the sealing surface. This slit is preferably between about 1/32 and about 1/4 of an inch from the sealing surface to ensure that a flap created by the slit exhibits sufficient flexibility to ensure that a minimal backpressure is created by gas flowing out the slit when the elastomeric boot is not in a sealing contact with another surface such as the inlet of a fuel tank. The slit can be of varying shapes, but a flat slit, parallel to the sealing surface, is convenient to provide. It is also convenient to provide this slit by cutting a molded elastomeric boot, but it could also be provided by gluing a thin flat elastomeric disk onto a boot that would also preferably, but not necessarily be elastic. This slit results in a flexible flap 167 extending across the sealing surface. A gas supply conduit 168 provides communication from a supply of gas (not shown) to a point within the slit inside of the sealing surface 169.

The gas supply conduit 168 is also in communication with a pressure switch 170. The pressure switch determines if the back pressure on the gas supply conduit exceeds a threshold pressure that is indicative of a sealing contact being made between the sealing surface and an inlet of a fuel tank. The gas supply conduit may provide, for example, between about 0.007 and about 0.7 SCFM of air to the dispenser of the present invention, and the pressure switch may detect a threshold pressure of, for example, four to about fifty inches of water. The threshold pressure will vary depending upon the volume of gas supplied to the slits, the smoothness of the slit, and distance and size of conduits that extend from the pressure sensor to the slit.

The pressure sensor is preferably placed in close proximity to the dispenser to result in a wide range of acceptable threshold pressures. The length of conduit between the pressure sensor and the slit is preferably less than about six feet and more preferably less than about one foot.

The supply of gas will pass through the gas supply conduit and out the slit creating very little back pressure when the elastomeric boot is not in sealing contact with a surface such as a fuel tank inlet. When the sealing surface is in such sealing contact, a significant pressure will build up within the gas supply conduit. The threshold pressure indicative of a sealing contact can therefore be any pressure greater than the normal back pressure created by the flow of gas to the slit and out the slit when the sealing surface is not in a sealing contact and less than the supply pressure of the gas.

A plurality of slits are preferably provided in order to enable detection of a poor sealing contact on at least two sides of the elastomeric boot. More than three slits are not preferred because more than three slits increases the complexity of the apparatus without significantly benefiting the result. Of course, one slit could be provided that extends around the entire sealing surface, and the gas supply conduit, particularly if a thin piece of elastomeric material is glued to a boot around the inside of the sealing surface between the two to form the slit. If a thin piece of elastomeric material were attached to a boot in such a fashion to form a continuous slit around the sealing surface, the gas supply conduit could include a hollow ring within the boot, behind the thin piece of elastomeric material, so that a poor sealing contact at any point could create a path of relatively low resistance for the gas to escape, thus preventing the threshold pressure from existing at the pressure sensor.

The pressure sensor generates a signal indicative of the threshold pressure being detected, and communicates this signal to a control system by a conduit 171. The control system could provide power to the pressure sensor by a power conduit 172. The control system generates a signal to disenable the fuel flow when a sealing contact is not detected, or liquid in the vapor recovery conduit is detected. This disenabling means is shown in FIG. 1 as a valve in the fuel flow conduit that is closed upon receiving a signal from the control system. Conversly, the control system could enable fuel flow when a sealing contact is indicated by the pressure sensor.

The pressure sensor could be a pneumatic circuit, using the back pressure on the conduit itself to provide a shutdown signal. This back pressure could be amplified using commercially available pneumatic logic components, and the resultant pneumatic output signal used as an input to a shutdown system. A pneumatic system is preferred because it avoids having electrical signals near the fuel dispenser, and has been found to be very fast, simple, and reliable.

The method of the present invention is preferably practiced in connection with a vehicle refuelling system, but the method is broadly applicable to may other systems as can be seen by a person of skill in the art.

A preferred automated refuelling system for use with the method of the present invention is disclosed in U.S. patent application Ser. No. 08/461,280, filed Jun. 5, 1995, incorporated herein by reference.

The previous descriptions of preferred embodiments are exemplary, and reference is made to the following claims to determine the full scope of the present invention.

We claim:

1. A fuel dispensing nozzle comprising:

a) a vapor recovery conduit effective to provide communication between a vapor space of a fuel tank to be refuelled and a system to remove vapors displaced by fuel added to the tank;

b) a fuel supply conduit;

c) a sealing means effective to mate in a sealing relationship with a fuel tank inlet and separate the vapor space and surrounding atmosphere other than through the system to remove vapors;

d) an optical liquid sensor within the vapor recovery conduit that is effective to generate a control signal when liquid is detected within the vapor recovery conduit; and e) a means to disenable fuel flow when a control signal is generated by the optical liquid sensor.

2. The fuel dispenser of claim 1 wherein the sealing means comprises a means to determine if a sealing relationship exists between the fuel dispenser and the fuel tank inlet.

3. The fuel dispenser of claim 2 wherein the sealing means further comprises an elastomeric boot having an elastomeric sealing surface and means to determine if a sealing relationship exists between the fuel dispenser and the fuel tank inlet comprised of at least one slit into the elastomeric boot extending from a point outside of the sealing surface to a point within the elastomeric boot inside of the sealing surface and the at least one slit being in communication with atmosphere surrounding the boot, a conduit terminating at the point within the elastomeric boot and providing communication with a source of gas supply, and a means to determine if the pressure within the conduit terminating at the point within the elastomeric boot exceeds a threshold pressure indicative of a sealing relationship between the sealing surface of the boot and a fuel tank inlet.

4. The fuel dispenser of claim 3 wherein the slit is essentially parallel to the sealing surface.

5. The fuel dispenser of claim 3 wherein the slit is between about 1/32 and 1/4 of an inch from the sealing surface.

6. The fuel dispenser of claim 3 wherein said at least one slit comprises a plurality of slits provided around the radius of the sealing surface.

7. The fuel dispenser of claim 1 wherein the optical liquid sensor comprises a reflector effective to reflect infrared light when the reflector is surrounded by gas, and not reflect infrared light when the reflector is surrounded by liquid, an infrared source and a receiver effective to detect reflected infrared light.

8. The fuel dispenser of claim 7 wherein the reflector is a polysulphone reflector.

9. A method to refill a fuel tank using a refuelling system having a vapor recovery system, the method comprising the steps of:

providing a fuel dispenser, the fuel dispenser comprising a vapor recovery conduit effective to provide communication between a vapor space of a fuel tank to be refuelled and a system to remove vapors displaced by fuel added to the tank, a fuel supply conduit, a sealing means effective to mate in a sealing relationship with a fuel tank inlet and separate the vapor space and surrounding atmosphere other than through the system to remove vapors, an optical liquid sensor within the vapor recovery conduit that is effective to generate a control signal when liquid is detected within the vapor recovery conduit, and a means to disenable fuel flow when a control signal is generated by the optical liquid sensor;

mating the sealing means to a fuel tank inlet;

passing fuel through the fuel supply conduit into the fuel tank;

removing vapors from the tank through the vapor recovery conduit at a volumetric rate that is about equal to the rate fuel is passed through the fuel supply conduit; and discontinuing fuel flow when liquid is detected by the optical liquid sensor.

* * * * *